US006634527B2

(12) United States Patent
Liu

(10) Patent No.: US 6,634,527 B2
(45) Date of Patent: Oct. 21, 2003

(54) CARRYING DEVICE OF A PISTOL

(76) Inventor: Chin-Sheng Liu, 58, Ma Yuan West St., Taichung (TW)

( * ) Notice: Subject to any disclaimer, the term of this patent is extended or adjusted under 35 U.S.C. 154(b) by 55 days.

(21) Appl. No.: 10/058,529

(22) Filed: Jan. 25, 2002

(65) Prior Publication Data

US 2003/0141331 A1 Jul. 31, 2003

(51) Int. Cl.[7] ..... F41C 33/04; F41A 17/00
(52) U.S. Cl. ..... 224/244; 224/198; 224/912
(58) Field of Search ..... 224/198, 243, 224/244, 911, 912; 42/70.11

(56) References Cited

U.S. PATENT DOCUMENTS 2,551,913 A * 5/1951 Toby ..... 224/911
3,866,811 A * 2/1975 Hamby ..... 224/911
4,934,574 A * 6/1990 Salandre ..... 224/244
5,449,103 A * 9/1995 Tilley ..... 224/244
5,598,958 A * 2/1997 Ryan, III et al. ..... 224/198
5,855,305 A * 1/1999 Nichols ..... 224/244
5,944,239 A * 8/1999 Rogers et al. ..... 224/911
6,112,962 A * 9/2000 Matthews ..... 224/912
6,230,946 B1 * 5/2001 Vor Keller et al. ..... 224/244
6,385,890 B1 * 5/2002 Amadini ..... 224/243
6,389,726 B1 * 5/2002 Bentley ..... 42/70.11
6,467,660 B1 * 10/2002 Rogers et al. ..... 224/243
2002/0144447 A1 * 10/2002 Hathaway ..... 42/70.11

* cited by examiner

*Primary Examiner*—Gary E. Elkins

(57) ABSTRACT

A carrying device of a pistol includes a main body, an unlock lever, a protective bracket locking ball, a movable member, a cover plate, and a connector. The trigger protective bracket of the pistol may be inserted into the protective bracket insertion recess of the main body and may be locked by the protective bracket locking ball rigidly and stably. Thus, it is necessary to press the push press section of the unlock lever downward or rotate the lock lever push member counterclockwise, so as to unlock the trigger protective bracket of the pistol, thereby preventing the pistol being robbed.

10 Claims, 10 Drawing Sheets

CARRYING DEVICE OF A PISTOL

BACKGROUND OF THE INVENTION

1. Field of the Invention

The present invention relates to a carrying device of a pistol, and more particularly to a carrying device of a pistol, wherein the trigger protective bracket of the pistol may be inserted into the protective bracket insertion recess of the main body and may be locked by the protective bracket locking ball rigidly and stably.

2. Description of the Related Art

A conventional pistol sheath in accordance with the prior art comprises a pistol fixing strap for positioning the pistol in the sheath. However, the user has to unfasten the pistol fixing strap for taking the pistol out of the sheath, thereby causing inconvenience to the user.

SUMMARY OF THE INVENTION

The present invention has arisen to mitigate and/or obviate the disadvantage of the conventional pistol sheath.

The primary objective of the present invention is to provide a carrying device of a pistol, wherein it is necessary to press the push press section of the unlock lever downward or rotate the lock lever push member counterclockwise, so as to unlock the trigger protective bracket of the pistol, thereby preventing the pistol being robbed.

Another objective of the present invention is to provide a carrying device of a pistol, wherein the trigger protective bracket of the pistol may be inserted into the protective bracket insertion recess of the main body and may be locked by the protective bracket locking ball rigidly and stably.

A further objective of the present invention is to provide a carrying device of a pistol, wherein the user only needs to press the push press section of the unlock lever downward, so as to unlock the trigger protective bracket of the pistol, so that the pistol may be removed easily and quickly.

A further objective of the present invention is to provide a carrying device of a pistol, wherein the pivot ball of the connector may be rotated freely so as to adjust the inclined angle of the carrying device, thereby facilitating the user carrying the carrying device.

In accordance with the present invention, there is provided a carrying device of a pistol, comprising a main body, an unlock lever, a protective bracket locking ball, a movable member, a cover plate, and a connector, wherein:

the main body has a center formed with a protective bracket insertion recess, and has a side wall formed with an oblique lever insertion channel, the lever insertion channel has a first side having a lower section provided with a limit rod and an upper section formed with a pivot recess, a lock lever push member is pivotally mounted in the pivot recess, the lever insertion channel has a second side having an upper section formed with an arcuate chamber, a mediate section formed with an ball receiving chamber, and a lower section formed with a receiving hole, the lock lever push member has a first end movably mounted in the arcuate chamber of the lever insertion channel, the ball receiving chamber of the lever insertion channel has an end face communicated with the protective bracket insertion recess, the receiving hole of the lever insertion channel has an end face communicated with the protective bracket insertion recess, the side wall of the main body has a lower section formed with a connector passage hole;

the unlock lever is slidably mounted in the lever insertion channel of the main body, and has a first side having a lower section formed with a limit slot for receiving the limit rod of the lever insertion channel, the unlock lever has a second side having a mediate section formed with a ball insertion recess, and a lower section formed with an insertion recess, the unlock lever has a rear wall having an upper section formed with a push member insertion recess for insertion of a second end of the lock lever push member, a first elastic member is mounted in the lever insertion channel, and is biased on the lower end of the unlock lever;

the protective bracket locking ball is received in the ball receiving chamber of the lever insertion channel, and is extended into the protective bracket insertion recess of the main body, a second elastic member is mounted in the ball receiving chamber of the lever insertion channel, and is biased between the protective bracket locking ball and the cover plate;

the movable member is slidably mounted in the receiving hole of the lever insertion channel, and has a first end formed with a spherical head extended into the protective bracket insertion recess of the main body, and a second end provided with a lug having an inner end face inserted into the insertion recess of the unlock lever, a third elastic member is mounted in the receiving hole of the lever insertion channel, and is biased between the lug of the movable member and the cover plate;

the cover plate is secured on the side wall of the main body, and has a lower section formed with a connector passage hole aligned with the connector passage hole of the main body; and the connector has a periphery provided with a connecting rod passed through the connector passage hole of the cover plate and the connector passage hole of the main body.

Further benefits and advantages of the present invention will become apparent after a careful reading of the detailed description with appropriate reference to the accompanying drawings.

DETAILED DESCRIPTION OF THE INVENTION

Figure 1:
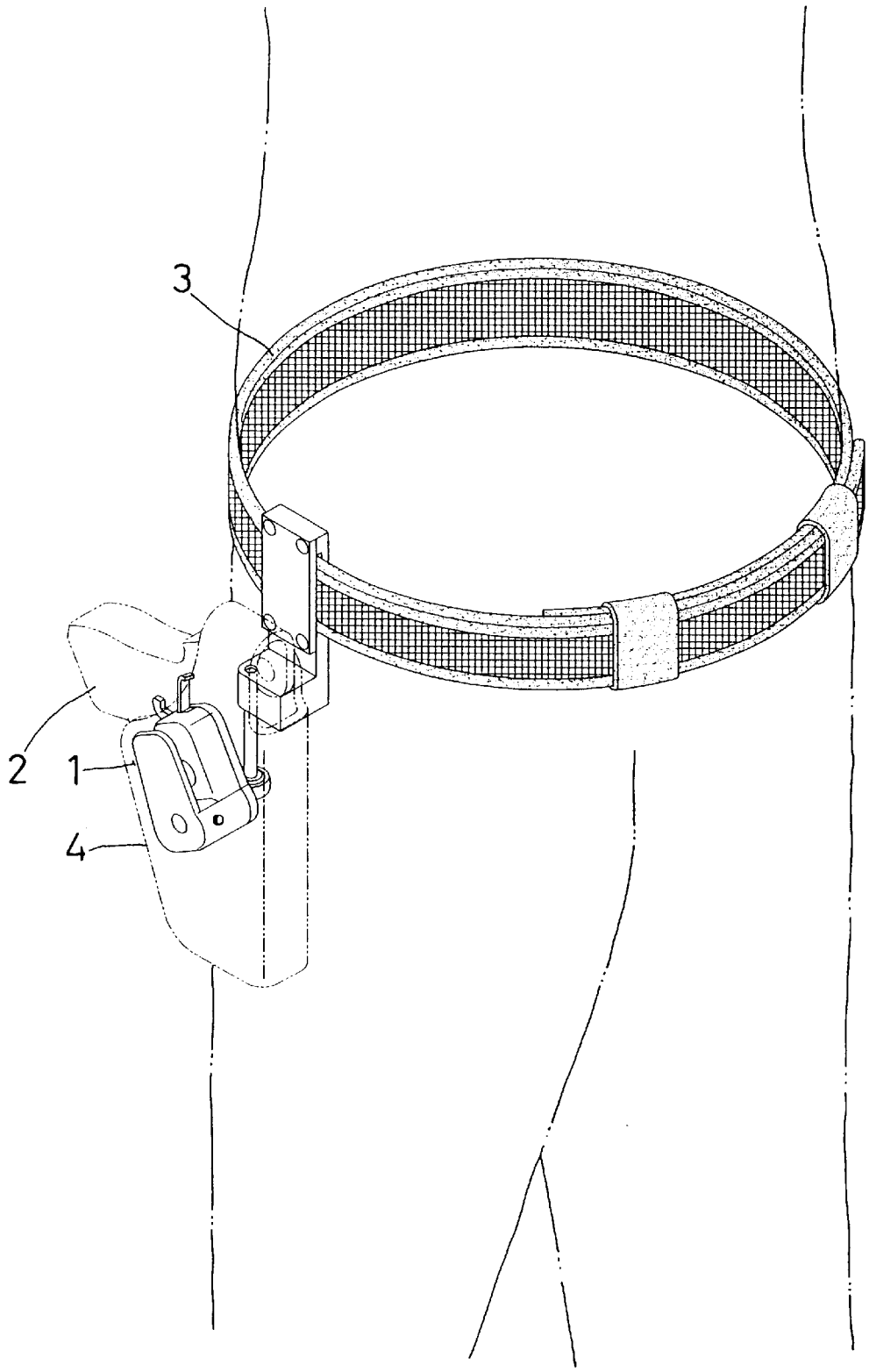
FIG. 1 is a perspective view of a carrying device of a pistol in accordance with a preferred embodiment of the present invention.
Figure 2:
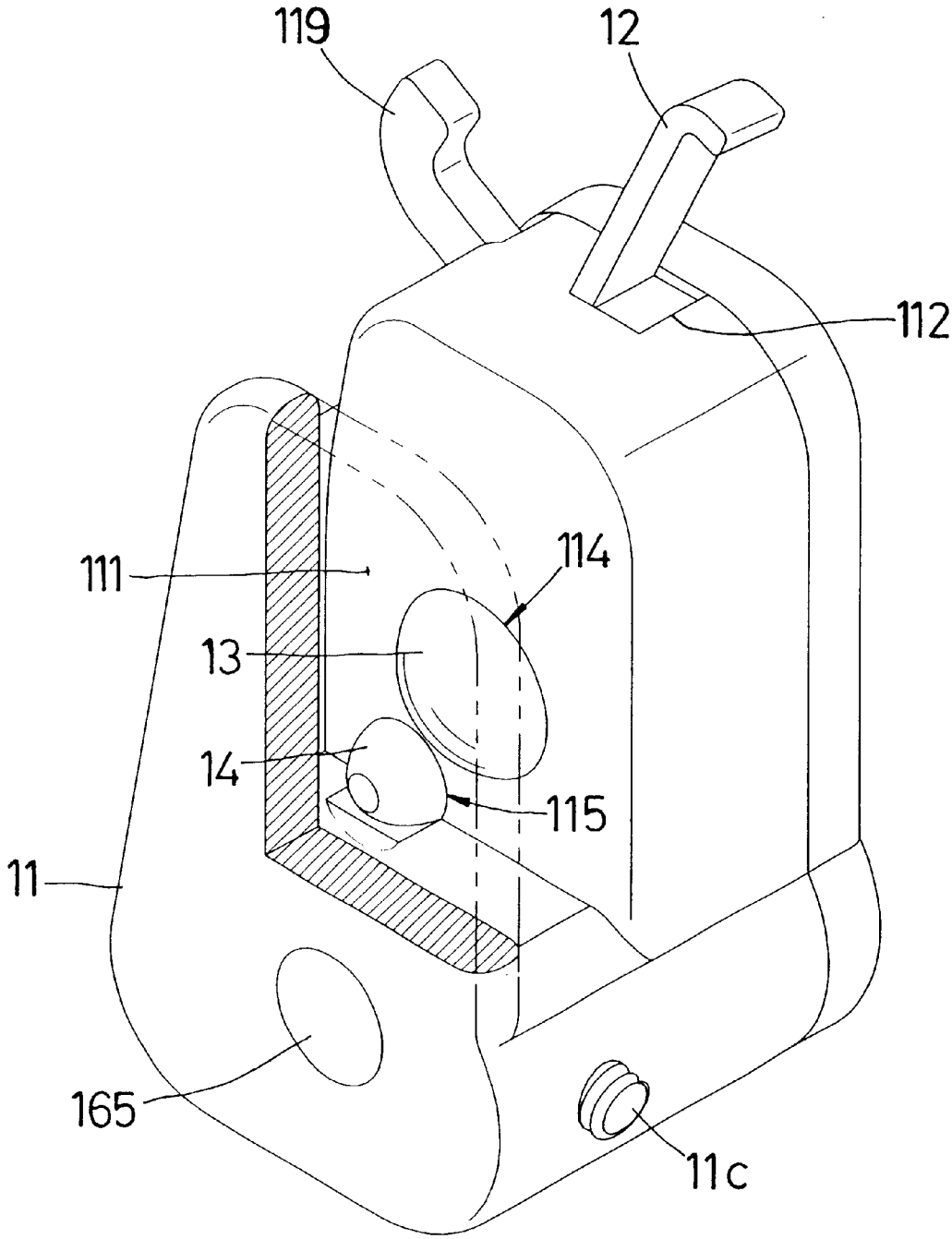
FIG. 2 is a perspective view of a carrying device of a pistol in accordance with a preferred embodiment of the present invention.

Referring to the drawings and initially to FIGS. 1–5, a carrying device 1 of a pistol in accordance with a preferred embodiment of the present invention nay be used to receive and position the trigger protective bracket 21 (see FIGS. 4 and 5) of a pistol 2, and comprises a main body 11, an unlock lever 12, a protective bracket locking ball 13, a movable member 14, a cover plate 15, and a connector 16.

The main body 11 has a center formed with a protective bracket insertion recess 111, and has a side wall formed with an oblique lever insertion channel 112. The lever insertion channel 112 has a lower portion formed with an oblique pit 11*b*. A barrel resting member 11*c* is screwed in a lower end of the oblique pit 11*b*.

The lever insertion channel 112 has a first side having a lower section provided with a limit rod 113 and an upper section formed with a pivot recess 117. The pivot recess 117 has a center formed with a pivot hole 118.

A lock lever push member 119 is pivotally mounted in the pivot recess 117, and is provided with a pivot axle 110 pivotally mounted in the pivot hole 118 of the pivot recess 117.

The lever insertion channel 112 has a second side having an upper section formed with an arcuate chamber 11*a*, a mediate section formed with an ball receiving chamber 114, and a lower section formed with a receiving hole 115. The lock lever push member 119 has a first end movably mounted in the arcuate chamber 11*a* of the lever insertion channel 112. The ball receiving chamber 114 of the lever insertion channel 112 has an end face communicated with the protective bracket insertion recess 111. The receiving hole 115 of the lever insertion channel 112 has an end face communicated with the protective bracket insertion recess 111.

The side wall of the main body 11 has a lower section formed with a connector passage hole 116. A stop screw 11*d* is screwed into the lower section of side wall of the main body 11, and is screwed into the connector passage hole 116.

The unlock lever 12 is slidably mounted in the lever insertion channel 112 of the main body 11, and has an upper end provided with a push press section 121. The unlock lever 12 has a first side having a lower section formed with a limit slot 122 opposite to the limit rod 113 of the lever insertion channel 112. The unlock lever 12 has a second side having a mediate section formed with a ball insertion recess 123, and a lower section formed with an insertion recess 124. The unlock lever 12 has a rear wall having an upper section formed with a push member insertion recess 126 for insertion of a second end of the lock lever push member 119. An elastic member 125 is mounted in the lever insertion channel 112, and is biased on the lower end of the unlock lever 12.

The protective bracket locking ball 13 may be received in the ball receiving chamber 114 of the lever insertion channel 112, and is extended into the protective bracket insertion recess 111 of the main body 11. An elastic member 131 is mounted in the ball receiving chamber 114 of the lever insertion channel 112, and is biased between the protective bracket locking ball 13 and the cover plate 15.

The movable member 14 is slidably mounted in the receiving hole 115 of the lever insertion channel 112, and has a first end formed with a spherical head extended into the protective bracket insertion recess 111 of the main body 11, and a second end provided with a lug 141 and formed with an annular groove 142. An elastic member 143 is mounted in the receiving hole 115 of the lever insertion channel 112, and is biased between the lug 141 of the movable member 14 and the cover plate 15.

The cover plate 15 is secured on the side wall of the main body 11, and has a mediate section formed with a receiving recess 151 for receiving the elastic member 143, and a lower section formed with a connector passage hole 152 aligned with the connector passage hole 116 of the main body 11.

The connector 16 has a center provided with a pivot ball 161 that may be rotated through 360 degrees, and has a periphery provided with a connecting rod 162 passed through the connector passage hole 152 of the cover plate 15 and the connector passage hole 116 of the main body 11. The connecting rod 162 is formed with an inner thread 164. A linking member 165 is mounted in the connector passage hole 116 of the main body 11, and is provided with an outer thread 166 screwed into the inner thread 164 of the connecting rod 162. An upright rod 163 has a lower end secured in the pivot ball 161, and an upper end that may be combined with a waist belt 3 of the pistol 2.

Figure 3:
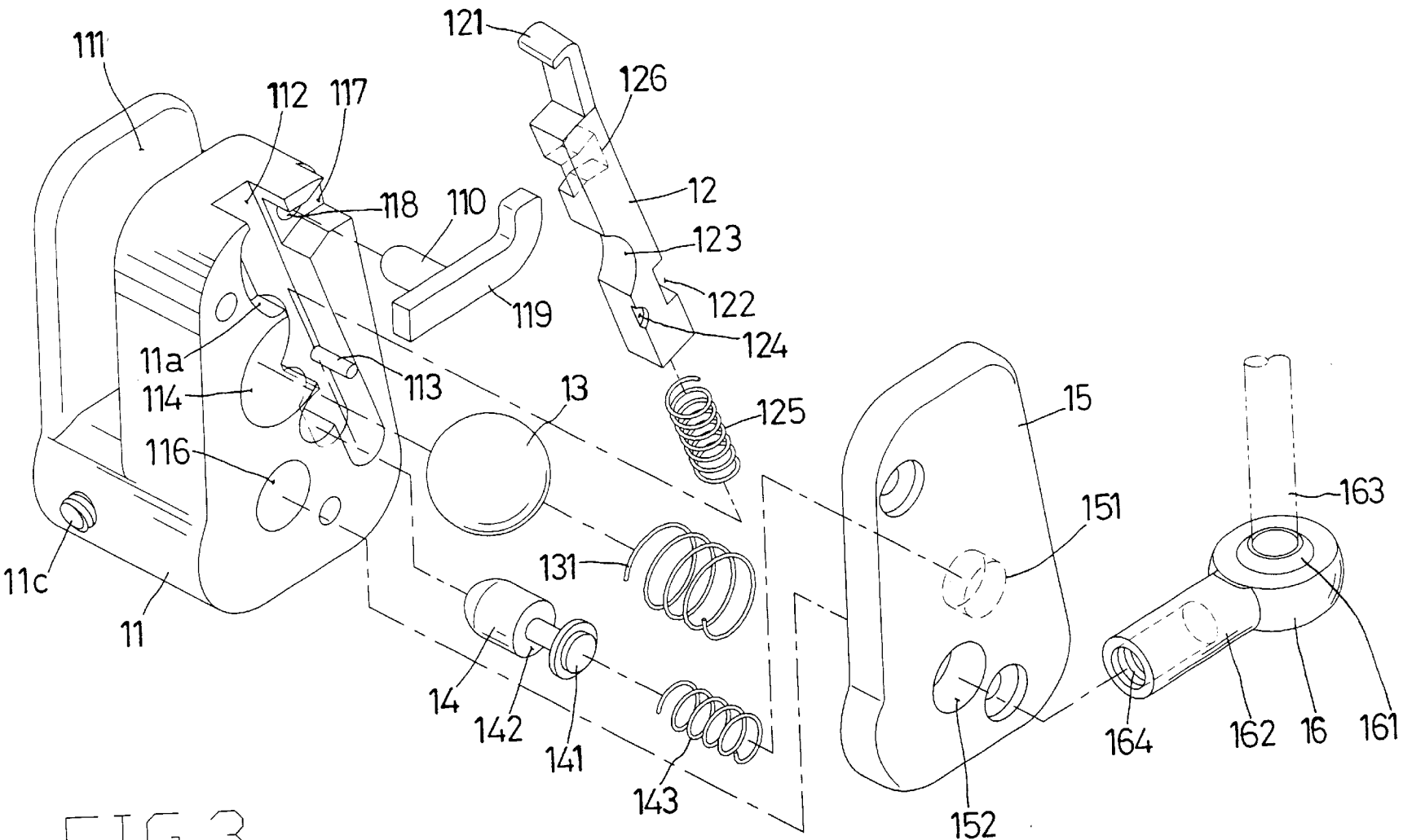
FIG. 3 is an exploded perspective assembly view of the carrying device of a pistol as shown in FIG. 2.
Figure 4:
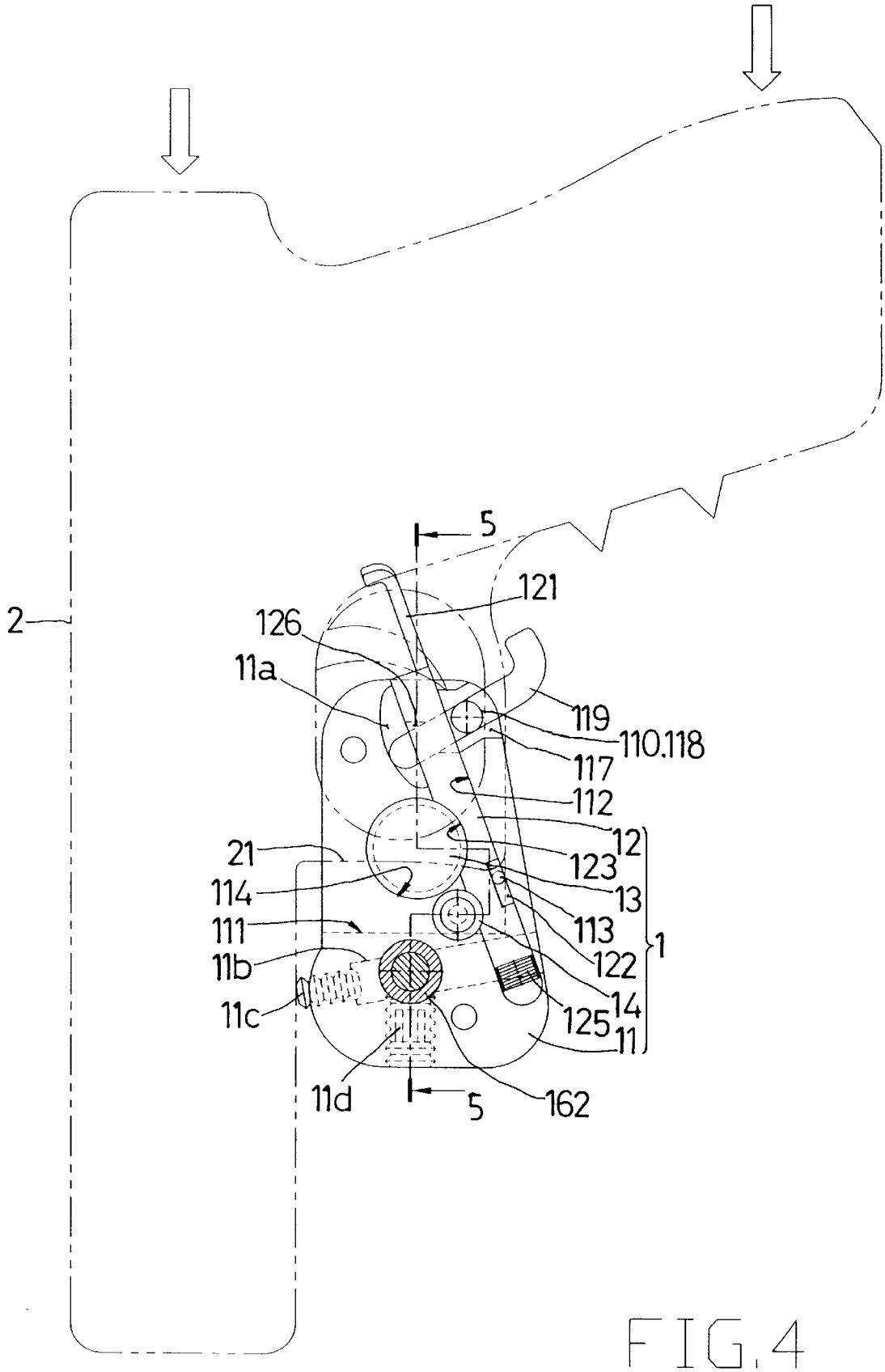
FIG. 4 is a side plan cross-sectional view of the carrying device of a pistol as shown in FIG. 2.
Figure 5:
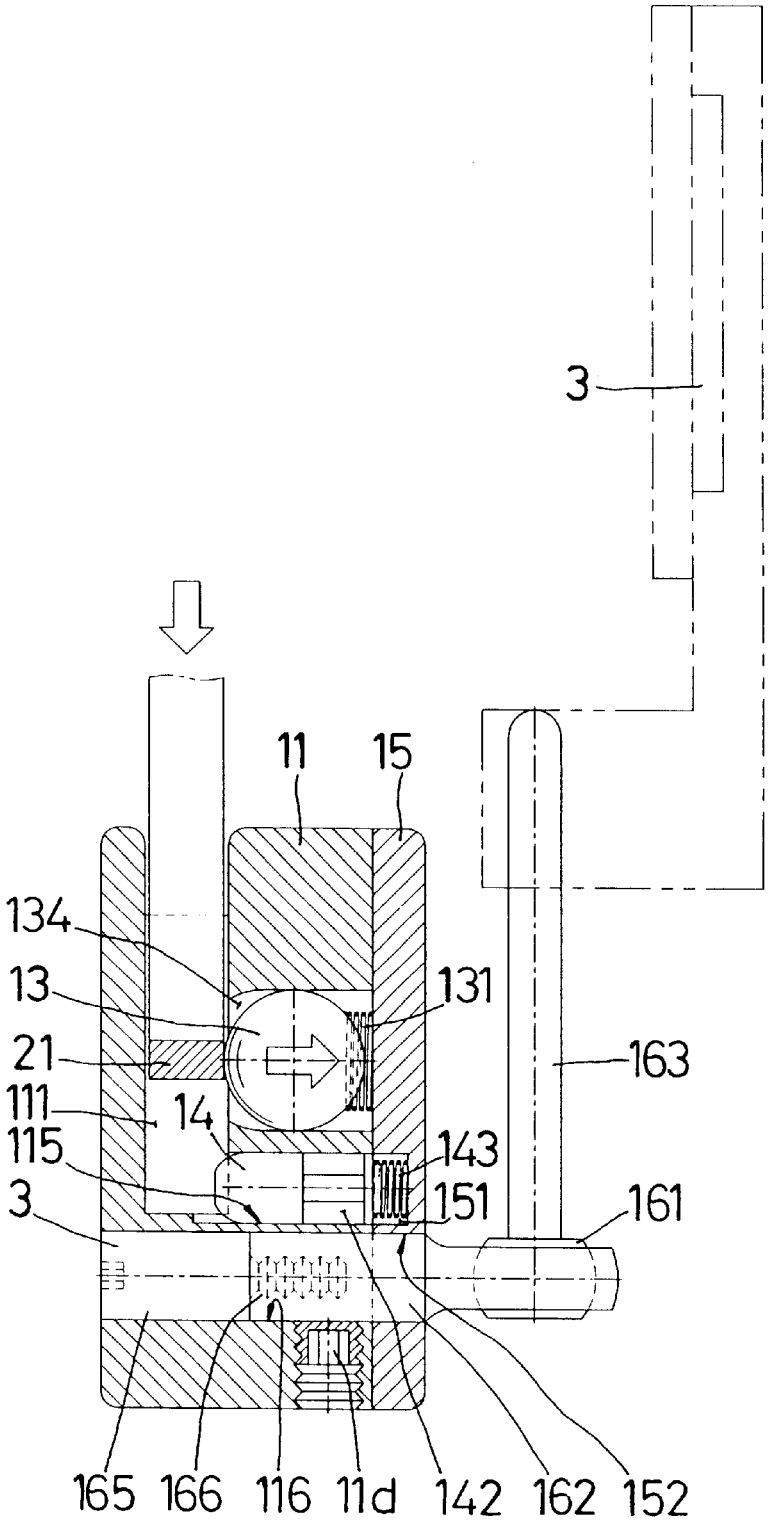
FIG. 5 is a cross-sectional view of the carrying device of a pistol taken along line 5—5 as shown in FIG. 4.

In assembly, referring to FIGS. 3–5, the protective bracket locking ball 13 and the elastic member 131 are received in the ball receiving chamber 114 of the lever insertion channel 112 of the main body 11. Then, the movable member 14 is received in the receiving hole 115 of the lever insertion channel 112 of the main body 11. Then, the pivot axle 110 of the lock lever push member 119 is pivotally mounted in the pivot hole 118 of the pivot recess 117, and the first end of the lock lever push member 119 is movably mounted in the arcuate chamber 11*a* of the lever insertion channel 112. Then, the elastic member 125 and the unlock lever 12 are received in the lever insertion channel 112 of the main body 11, while the limit rod 113 of the lever insertion channel 112 is received in the limit slot 122 of the unlock lever 12, and the inner end face of the lug 141 of the movable member 14 is inserted into the insertion recess 124 of the unlock lever 12.

Then, a first end of the elastic member 143 is secured on the lug 141 of the movable member 14 and the cover plate 15, and a second end of the elastic member 143 is secured in the receiving recess 151 of the cover plate 15. Then, the connecting rod 162 of the connector 16 is passed through the connector passage hole 152 of the cover plate 15 and the connector passage hole 116 of the main body 11, and is screwed and positioned by the linking member 165 and the stop screw 11*d* as shown in FIG. 5. Then, the upper end of the upright rod 163 of the connector 16 may be combined with the waist belt 3 of the pistol 2 as shown in FIG. 1, thereby facilitating insertion of the trigger protective bracket 21 of the pistol 2. The carrying device 1 may be combined with the sheath 4 of the pistol 2, thereby facilitating the user carrying the pistol 2.

When the trigger protective bracket 21 of the pistol 2 is inserted into the protective bracket insertion recess 111 of the main body 11 to press the protective bracket locking ball 13, the protective bracket locking ball 13 and the elastic member 131 are pressed by the trigger protective bracket 21 of the pistol 2 to retract into the ball receiving chamber 114 of the lever insertion channel 112 of the main body 11 and the ball insertion recess 123 of the unlock lever 12 as shown in FIGS. 4 and 5. At this time, the inner end face of the lug 141 of the movable member 14 is inserted into the insertion recess 124 of the unlock lever 12, thereby fixing the unlock lever 12, and the elastic member 125 is compressed by the unlock lever 12.

Figure 6:
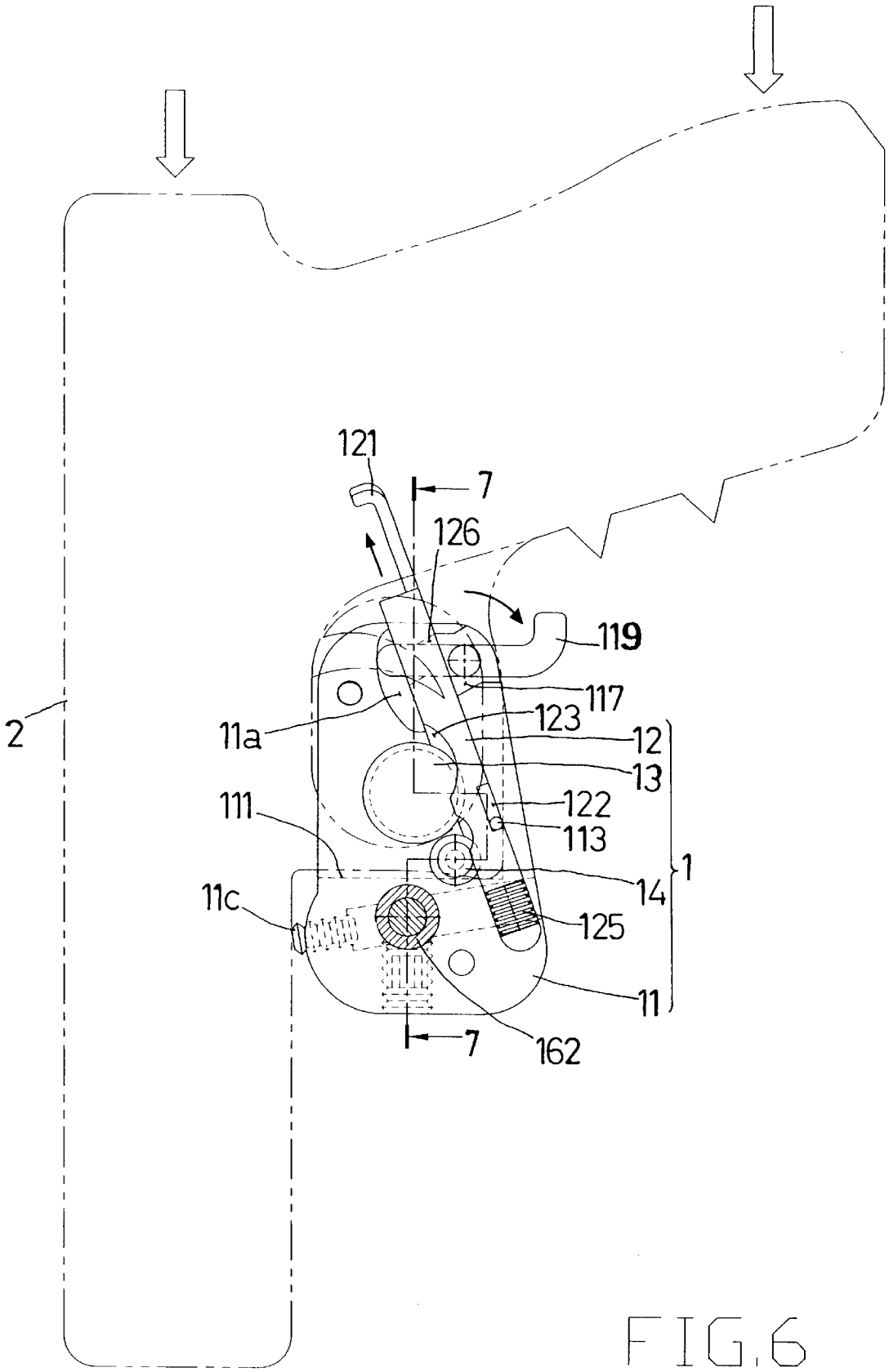
FIG. 6 is a schematic operational view of the carrying device of a pistol as shown in FIG. 4 in use.
Figure 7:
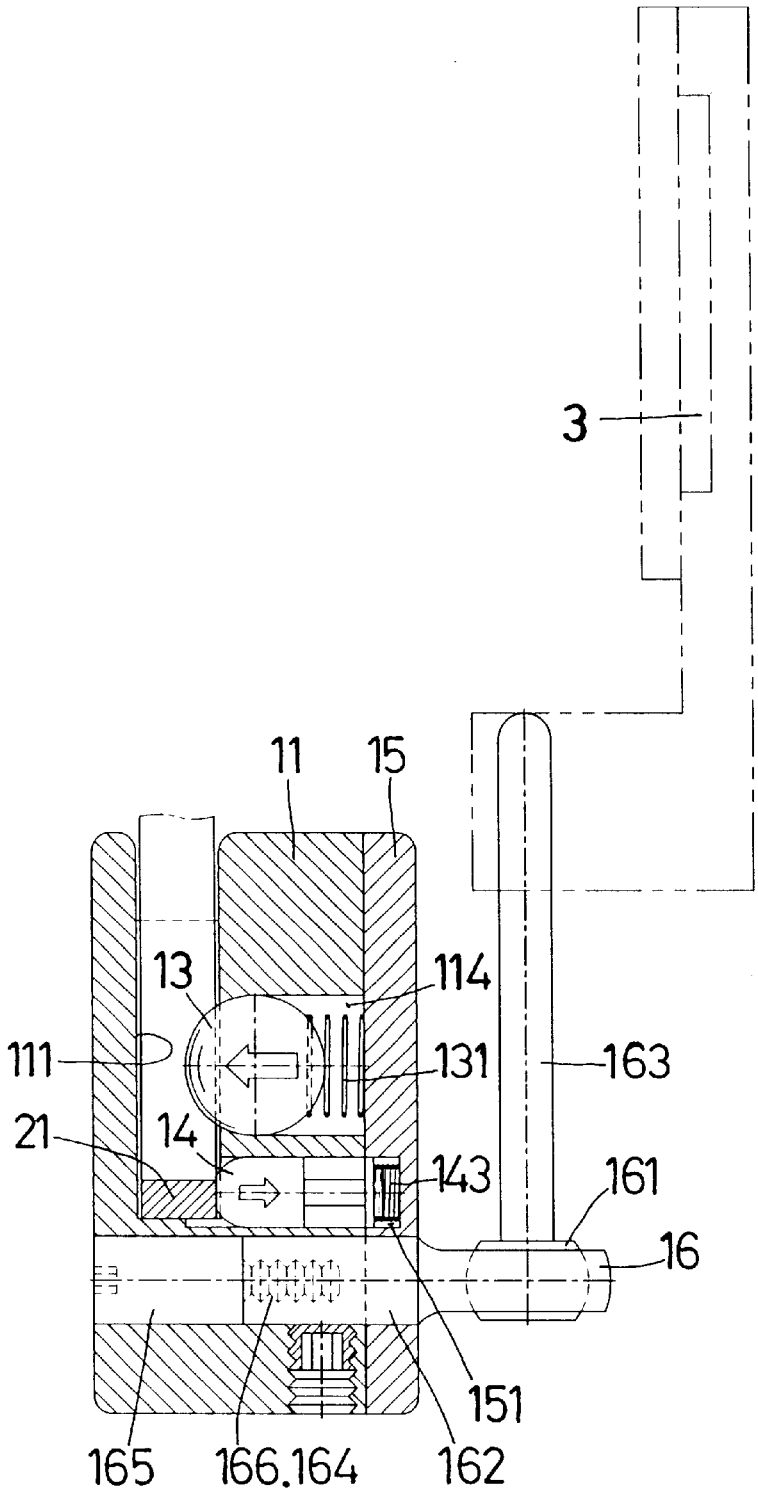
FIG. 7 is a schematic operational view of the carrying device of a pistol as shown in FIG. 5 in use.

When the trigger protective bracket 21 of the pistol 2 is further moved in the protective bracket insertion recess 111 of the main body 11 to press the movable member 14 as shown in FIGS. 6 and 7, the protective bracket locking ball 13 is pressed to extend into the opening of the trigger protective bracket 21 of the pistol 2 by the restoring force of the elastic member 131, and the movable member 14 is pressed by the trigger protective bracket 21 of the pistol 2 to retract into the receiving hole 115, so that the lug 141 may be moved to detach the inner end face of the lug 141 of the movable member 14 from the insertion recess 124 of the unlock lever 12, so that the unlock lever 12 may be pressed upward by the restoring force of the elastic member 125, to press and position the protective bracket locking ball 13 and the elastic member 131 without movement, thereby locking the trigger protective bracket 21 of the pistol 2 by the protective bracket locking ball 13. At this time, the barrel resting member 11*c* is rested on the barrel of the pistol 2 for supporting the barrel of the pistol 2.

Figure 8:
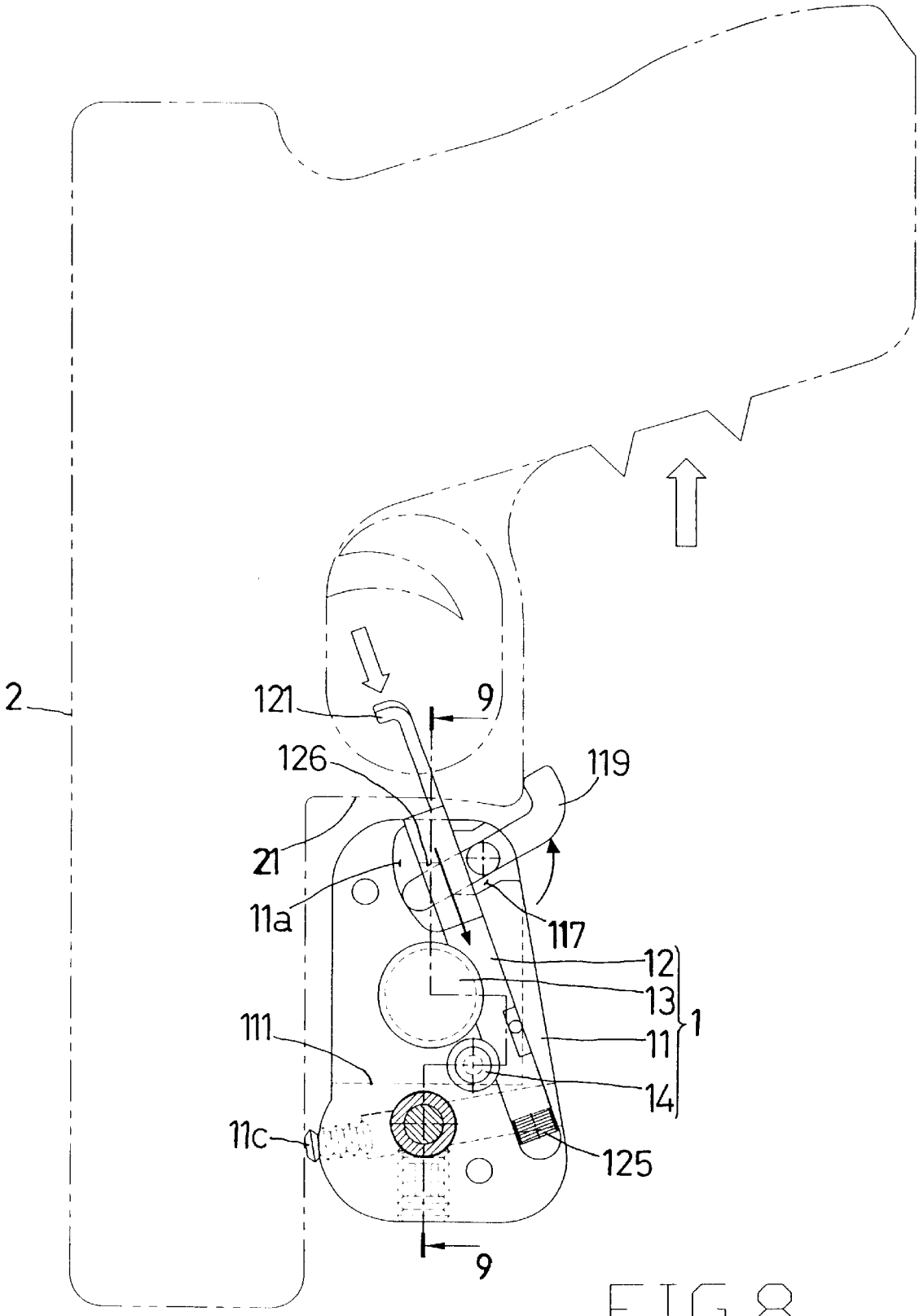
FIG. 8 is a schematic operational view of the carrying device of a pistol as shown in FIG. 6 in use.
Figure 9:
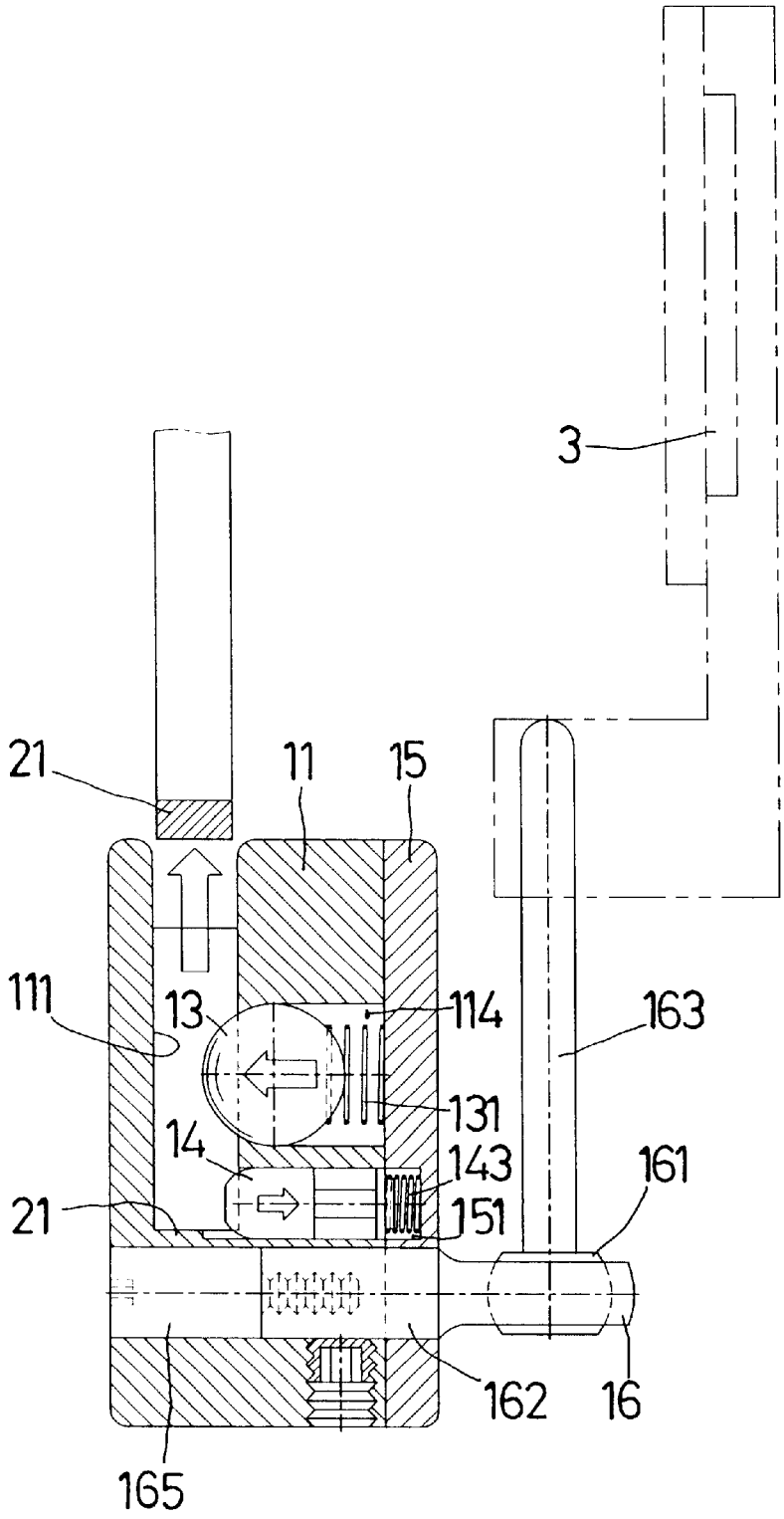
FIG. 9 is a schematic operational view of the carrying device of a pistol as shown in FIG. 7 in use.
Figure 10:
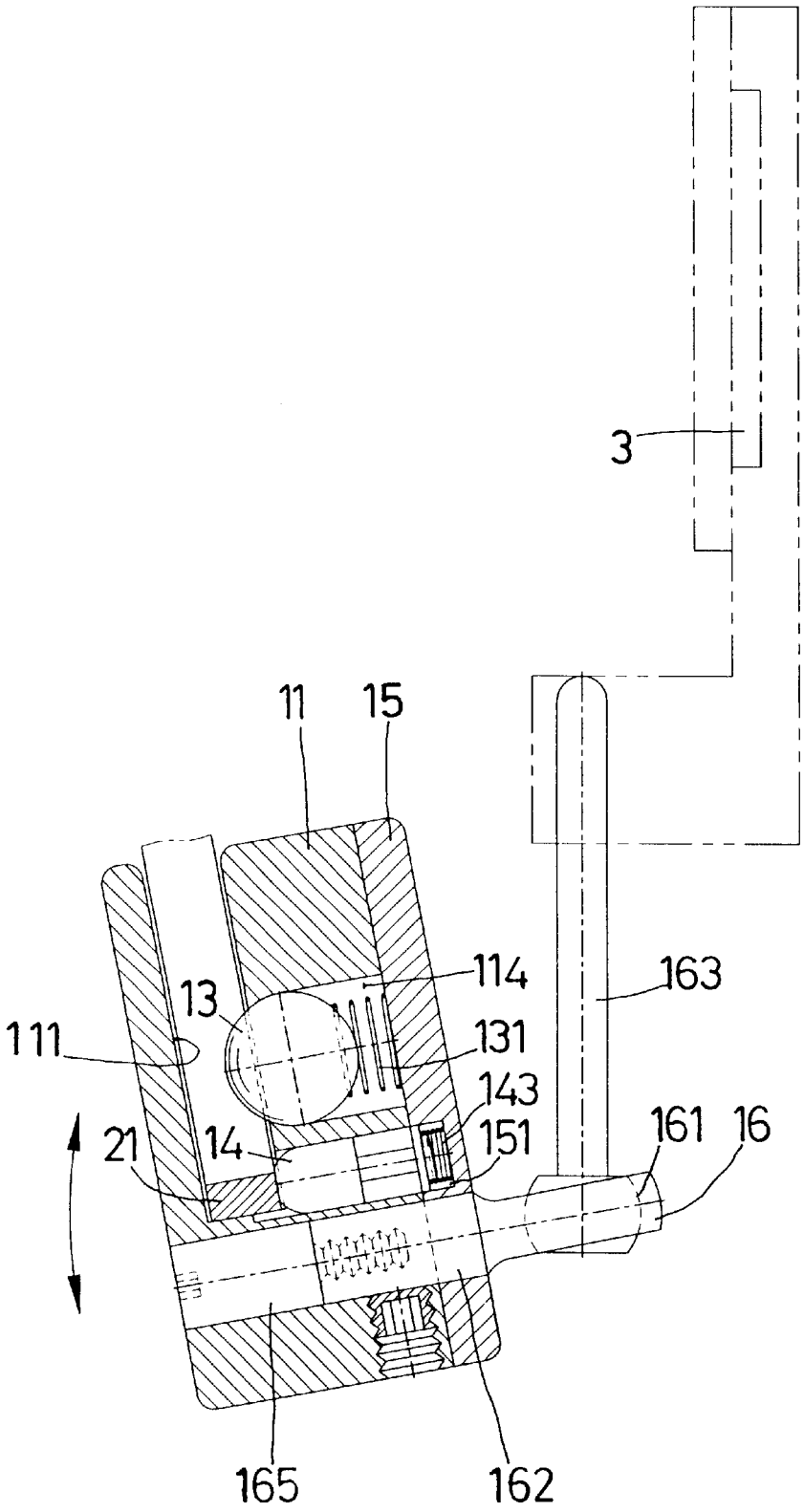
FIG. 10 is a schematic operational view of the carrying device of a pistol as shown in FIG. 5 in use.

As shown in FIGS. 8 and 9, the push press section 121 of the unlock lever 12 may be pressed downward or the lock lever push member 119 may be rotated counterclockwise, so that the unlock lever 12 may be moved downward to compress the elastic member 125, until the ball insertion recess 123 of the unlock lever 12 aligns with the protective bracket locking ball 13 and the elastic member 131, so that the protective bracket locking ball 13 and the elastic member 131 may be received in the ball insertion recess 123 of the unlock lever 12, thereby unlocking the trigger protective bracket 21 of the pistol 2 from the protective bracket locking ball 13, so that the trigger protective bracket 21 of the pistol 2 may be moved outward from the protective bracket insertion recess 111 of the main body 11. At the same time, the movable 14 is moved by the restoring force of the elastic member 143, so that the inner end face of the lug 141 of the movable member 14 may be inserted into the insertion recess 124 of the unlock lever 12 again, thereby fixing the unlock lever 12.

Accordingly, the carrying device 1 of a pistol in accordance with a referred embodiment of the present invention has the following advantages.

1. The trigger protective bracket 21 of the pistol 2 may be inserted into the protective bracket insertion recess 111 of the main body 11 and may be locked by the protective bracket locking ball 13 rigidly and stably.

2. It is necessary to press the push press section 121 of the unlock lever 12 downward or rotate the lock lever push member 119 counterclockwise, so as to unlock the trigger protective bracket 21 of the pistol 2, thereby preventing the pistol 2 being robbed.

3. The user only needs to press the push press section 121 of the unlock lever 12 downward, so as to unlock the trigger protective bracket 21 of the pistol 2, so that the pistol 2 may be removed easily and quickly.

4. The pivot ball 161 of the connector 16 may be rotated freely so as to adjust the inclined angle of the carrying device 1, thereby facilitating the user carrying the carrying device 1.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A carrying device of a pistol, comprising a main body, an unlock lever, a protective bracket locking ball, a movable member, a cover plate, and a connector, wherein:

the main body has a center formed with a protective bracket insertion recess, and has a side wall formed with an oblique lever insertion channel, the lever insertion channel has a first side having a lower section provided with a limit rod and an upper section formed with a pivot recess, a lock lever push member is pivotally mounted in the pivot recess, the lever insertion channel has a second side having an upper section formed with an arcuate chamber, a mediate section formed with an ball receiving chamber, and a lower section formed with a receiving hole, the lock lever push member has a first end movably mounted in the arcuate chamber of the lever insertion channel, the ball receiving chamber of the lever insertion channel has an end face communicated with the protective bracket insertion recess, the receiving hole of the lever insertion channel has an end face communicated with the protective bracket insertion recess, the side wall of the main body has a lower section formed with a connector passage hole;

the unlock lever is slidably mounted in the lever insertion channel of the main body, and has a first side having a lower section formed with a limit slot for receiving the limit rod of the lever insertion channel, the unlock lever has a second side having a mediate section formed with a ball insertion recess, and a lower section formed with an insertion recess, the unlock lever has a rear wall having an upper section formed with a push member insertion recess for insertion of a second end of the lock lever push member, a first elastic member is mounted in the lever insertion channel, and is biased on the lower end of the unlock lever;

the protective bracket locking ball is received in the ball receiving chamber of the lever insertion channel, and is extended into the protective bracket insertion recess of the main body, a second elastic member is mounted in the ball receiving chamber of the lever insertion channel, and is biased between the protective bracket locking ball and the cover plate;

the movable member is slidably mounted in the receiving hole of the lever insertion channel, and has a first end formed with a spherical head extended into the protective bracket insertion recess of the main body, and a second end provided with a lug having an inner end face inserted into the insertion recess of the unlock lever, a third elastic member is mounted in the receiving hole of the lever insertion channel, and is biased between the lug of the movable member and the cover plate;

the cover plate is secured on the side wall of the main body, and has a lower section formed with a connector passage hole aligned with the connector passage hole of the main body; and the connector has a periphery provided with a connecting rod passed through the connector passage hole of the cover plate and the connector passage hole of the main body.

2. The carrying device of a pistol in accordance with claim 1, wherein the lever insertion channel has a lower portion formed with an oblique pit, and a barrel resting member is screwed in a lower end of the oblique pit.

3. The carrying device of a pistol in accordance with claim 1, wherein the pivot recess has a center formed with a pivot hole, and the lock lever push member is provided with a pivot axle pivotally mounted in the pivot hole of the pivot recess.

4. The carrying device of a pistol in accordance with claim 1, further comprising a stop screw screwed into the lower section of side wall of the main body, and screwed into the connector passage hole.

5. The carrying device of a pistol in accordance with claim 1, wherein the unlock lever has an upper end provided with a push press section.

6. The carrying device of a pistol in accordance with claim 1, wherein the second end of the movable member is formed with an annular groove.

7. The carrying device of a pistol in accordance with claim 1, wherein the cover plate has a mediate section formed with a receiving recess for receiving the third elastic member.

8. The carrying device of a pistol in accordance with claim 1, wherein the connector has a center provided with a pivot ball that may be rotated through 360 degrees.

9. The carrying device of a pistol in accordance with claim 1, wherein the connecting rod is formed with an inner thread, and a linking member is mounted in the connector passage hole of the main body, and is provided with an outer thread screwed into the inner thread of the connecting rod.

10. The carrying device of a pistol in accordance with claim 1, wherein the connector (16) includes an upright rod which has a lower end secured in the pivot ball, and an upper end that may be combined with a waist belt of the pistol.

* * * * *